US012480728B2

(12) United States Patent
Janczura et al.

(10) Patent No.: US 12,480,728 B2
(45) Date of Patent: Nov. 25, 2025

(54) FIREARM TRIGGER WITH SAFETY BLADE

(71) Applicant: Tyrant Designs CNC, LLC, Chicago, IL (US)

(72) Inventors: Thomas Janczura, Chicago, IL (US); Christopher Greenwalt, Chicago, IL (US)

(73) Assignee: Tyrant Designs CNC, LLC, Chicago, IL (US)

( * ) Notice: Subject to any disclaimer, the term of this patent is extended or adjusted under 35 U.S.C. 154(b) by 11 days.

(21) Appl. No.: 18/633,077

(22) Filed: Apr. 11, 2024

(65) Prior Publication Data

US 2024/0344796 A1 Oct. 17, 2024

Related U.S. Application Data

(60) Provisional application No. 63/458,849, filed on Apr. 12, 2023.

(51) Int. Cl.
*F41A 17/46* (2006.01)

(52) U.S. Cl.
CPC ..... *F41A 17/46* (2013.01)

(58) Field of Classification Search
CPC ..... F41A 17/72; F41A 17/46
See application file for complete search history.

(56) References Cited

U.S. PATENT DOCUMENTS

| | | | | |
|---|---|---|---|---|
| 3,269,045 | A * | 8/1966 | Mcgaughey | F41A 19/16 42/65 |
| 5,105,569 | A * | 4/1992 | Straitiff | F41A 3/02 42/2 |
| 5,355,768 | A * | 10/1994 | Felk | F41A 17/36 89/137 |
| 6,223,460 | B1 * | 5/2001 | Schmitter | F41A 17/46 42/70.06 |
| 6,843,013 | B2 * | 1/2005 | Cutini | F41A 17/46 42/70.01 |
| D658,263 | S | 4/2012 | Nierenberg | |
| D664,234 | S | 7/2012 | Nierenberg | |
| D666,687 | S | 9/2012 | Nierenberg | |
| D692,086 | S | 10/2013 | Nierenberg | |
| D711,491 | S | 8/2014 | Nierenberg | |
| 9,194,649 | B2 | 11/2015 | Nierenberg | |
| 9,194,651 | B2 | 11/2015 | Nierenberg | |
| 9,441,897 | B2 * | 9/2016 | Mather | F41A 17/46 |
| 9,726,449 | B2 | 8/2017 | Spinner et al. | |
| 9,739,557 | B2 | 8/2017 | Lee | |
| 10,030,926 | B2 * | 7/2018 | Mather | F41A 19/10 |
| 10,030,927 | B1 | 7/2018 | Theiss | |
| 10,060,693 | B2 * | 8/2018 | Bubits | F41C 3/00 |
| 10,247,502 | B2 * | 4/2019 | Kilic | F41A 17/46 |
| 10,317,158 | B2 * | 6/2019 | Geissele | F41A 19/10 |
| 10,801,794 | B2 * | 10/2020 | Geissele | F41A 19/10 |

(Continued)

*Primary Examiner* — Michelle Clement
(74) *Attorney, Agent, or Firm* — Benjamin D. Rotman; UB Greensfelder LLP

(57) ABSTRACT

A safety trigger system comprising a trigger housing, a safety blade member, a safety latch member configured to interfere with a firearm housing preventing the entire trigger stroke and the release of the firearm firing pin. The safety blade member and the safety latch member disposed within the trigger housing and held into a pre-depressed state through resistance force provided by a resistance member.

9 Claims, 7 Drawing Sheets

(56) References Cited

U.S. PATENT DOCUMENTS

| | | | | |
|---|---|---|---|---|
| 11,079,193 | B1 * | 8/2021 | Niswander | F41A 17/46 |
| 11,085,722 | B2 * | 8/2021 | Aaronson | F41A 19/10 |
| 11,187,482 | B2 * | 11/2021 | Bloomfield | F41A 17/46 |
| 11,274,894 | B1 * | 3/2022 | Hill | F41A 17/46 |
| 11,365,946 | B2 * | 6/2022 | Lawrie | F41A 17/063 |
| 11,466,950 | B2 * | 10/2022 | Nieh | F41A 17/08 |
| 11,566,862 | B2 | 1/2023 | Olson et al. | |
| 11,578,939 | B2 * | 2/2023 | Lesenfants | F41A 17/56 |
| 11,578,940 | B2 * | 2/2023 | Lake | F41A 19/12 |
| 11,598,597 | B2 * | 3/2023 | Barrett | F41A 17/46 |
| 11,740,045 | B2 * | 8/2023 | Niswander | F41A 17/46 42/70.06 |
| 11,953,277 | B1 * | 4/2024 | Tseng | F41A 17/66 |
| 12,152,849 | B1 * | 11/2024 | Bray | F41A 19/12 |
| 12,181,237 | B2 * | 12/2024 | Muska | F41A 17/46 |
| 12,372,316 | B2 * | 7/2025 | Rainaud | F41A 11/00 |
| 2010/0024273 | A1 * | 2/2010 | Duperry | F41A 19/16 42/69.01 |
| 2012/0317854 | A1 | 12/2012 | Nierenberg | |
| 2014/0245648 | A1 | 9/2014 | Nierenberg | |
| 2014/0373414 | A1 | 12/2014 | Nierenberg | |
| 2019/0195588 | A1 * | 6/2019 | Lake | F41A 19/10 |
| 2019/0219351 | A1 * | 7/2019 | Weinberg | F41A 17/42 |
| 2021/0341242 | A1 * | 11/2021 | Niswander | F41A 17/46 |
| 2022/0163279 | A1 * | 5/2022 | Liu | F41A 17/46 |
| 2023/0349656 | A1 * | 11/2023 | Niswander | F41A 17/46 |
| 2024/0344796 | A1 * | 10/2024 | Janczura | F41A 17/46 |
| 2025/0198716 | A1 * | 6/2025 | Ye | F41A 17/38 |

* cited by examiner

FIREARM TRIGGER WITH SAFETY BLADE

CROSS REFERENCE TO RELATED APPLICATIONS

The present application claims priority from U.S. Provisional Application Ser. No. 63/458,849 filed on Apr. 12, 2023 all of which is incorporated by reference in its entirety herein.

BACKGROUND OF THE INVENTION

The present invention generally relates to the field firearm triggers. More particularly, the invention relates to a firearm trigger comprising a safety blade configured to interfere with a firearm housing preventing full rotation of the trigger.

Firearms employ several safety features configured to prevent the firearm from accidentally firing.

The present invention attempts to overcome the shortcomings of previous safety systems by providing an enhanced safety blade for a trigger that limits depression travel and utilizes the firearm housing to prevent full rotation of the trigger and further prevent accidental firing.

SUMMARY OF THE INVENTION

In view of the above, a novel trigger and safety blade system is provided herein. The trigger system comprises a trigger housing, a safety blade member, a safety latch member, a resistance member, and a plurality of pivot members.

In one aspect, the trigger housing comprises a slot configured to accommodate the assembly of safety blade and the safety latch. The safety blade is disposed in the trigger housing slot and rotatably coupled to the trigger housing through a first pivot member. In an assembled first state, a portion of the safety blade member protrudes through the front of the trigger housing allowing access for digital depression. The safety latch member is disposed in a rear portion of the trigger housing slot and rotatably coupled to the trigger housing through a second pivot member. In an assembled state, a bottom portion of the safety latch is physically engaged with a bottom rear portion of the safety blade and a top portion of the safety latch protrudes from a top portion of the trigger housing.

In another aspect, the resistance member is coupled to the safety latch member and a and the trigger housing. The resistance member is configured to apply a resistive force between the trigger housing and the safety latch member rotatably biasing the safety latch member along the second pivot member into the first assembled pre-depressed position.

In yet another aspect, the resistance member is coupled to the first pivot member and the second pivot member and configured to apply a resistive force to both the safety blade and safety latch biasing both the safety blade and safety latch into the assembled, pre-depressed positions. Upon depression of the safety blade, the resistive force of the resistive member is overcome. In a depressed state, the safety blade is rotated into the trigger housing, which in turn applies a force onto the bottom portion of the safety latch causing the safety latch to overcome the resistive force of the resistance member and rotate about the second pivot member In operation, the trigger system is assembled into a firearm. In the assembled state, the second portion of the safety latch interferes with the firearm housing and prevents travel of the trigger without depression of the safety blade.

In a pre-depressed state, the trigger is prevented from traveling the entire trigger stroke required to release the firing pin of the firearm. In a depressed state, the depression of the safety blade applies a force to the first portion of the safety latch causing the rotation of the safety latch. The safety latch in a depressed rotated position no longer interferes with the firearm housing and allows for the trigger to travel the entire trigger stroke and release the firing pin of the firearm.

The interaction between the safety blade and the safety latch allows for a multiplication of the travel distances between each part respectively. Ultimately, this interaction allows for the safety blade to remain within a comfortable travel range, while the safety latch travels at a greater or smaller distance (depending on the firearm design)—to achieve locking and unlocking of the trigger assembly.

In another aspect, a method of securing a firearm comprises the steps of installing a safety trigger assembly in a firearm housing comprising a trigger housing, a safety blade member, a safety latch member, a resistance member, and a plurality of pivot members wherein in a first state, the safety latch member interferes with the firearm housing preventing a complete trigger travel stroke and preventing the release of the firearm firing pin.

In yet another aspect, a method firing a firearm comprising a safety trigger assembly comprises the steps of depressing a the trigger housing and safety blade, rotating the safety blade into the safety latch, rotating the safety latch to clear an interference with the firearm housing, allowing the full trigger stroke to release the firearm firing pin.

The methods, systems, apparatuses are set forth in part in the description which follows, and in part will be obvious from the description, or can be learned by practice of the methods, apparatuses, and systems. The advantages of the methods, apparatuses, and systems will be realized and attained by means of the elements and combinations particularly pointed out in the appended claims. It is understood that both the foregoing general description and the following detailed description are exemplary and explanatory only and are not restrictive of the methods, apparatuses, and systems, as claimed.

BRIEF DESCRIPTION OF THE DRAWINGS

In the accompanying figures, like elements are identified by like reference numerals among the several preferred embodiments of the present invention.

Other aspects and advantages of the present invention will become apparent upon consideration of the following detailed description, wherein similar structures have similar reference numerals.

DETAILED DESCRIPTION OF THE PREFERRED EMBODIMENTS

The foregoing and other features and advantages of the invention will become more apparent from the following detailed description of exemplary embodiments, read in conjunction with the accompanying drawings. The detailed description and drawings are merely illustrative of the invention rather than limiting, the scope of the invention being defined by the appended claims and equivalents thereof.

Figure 1:
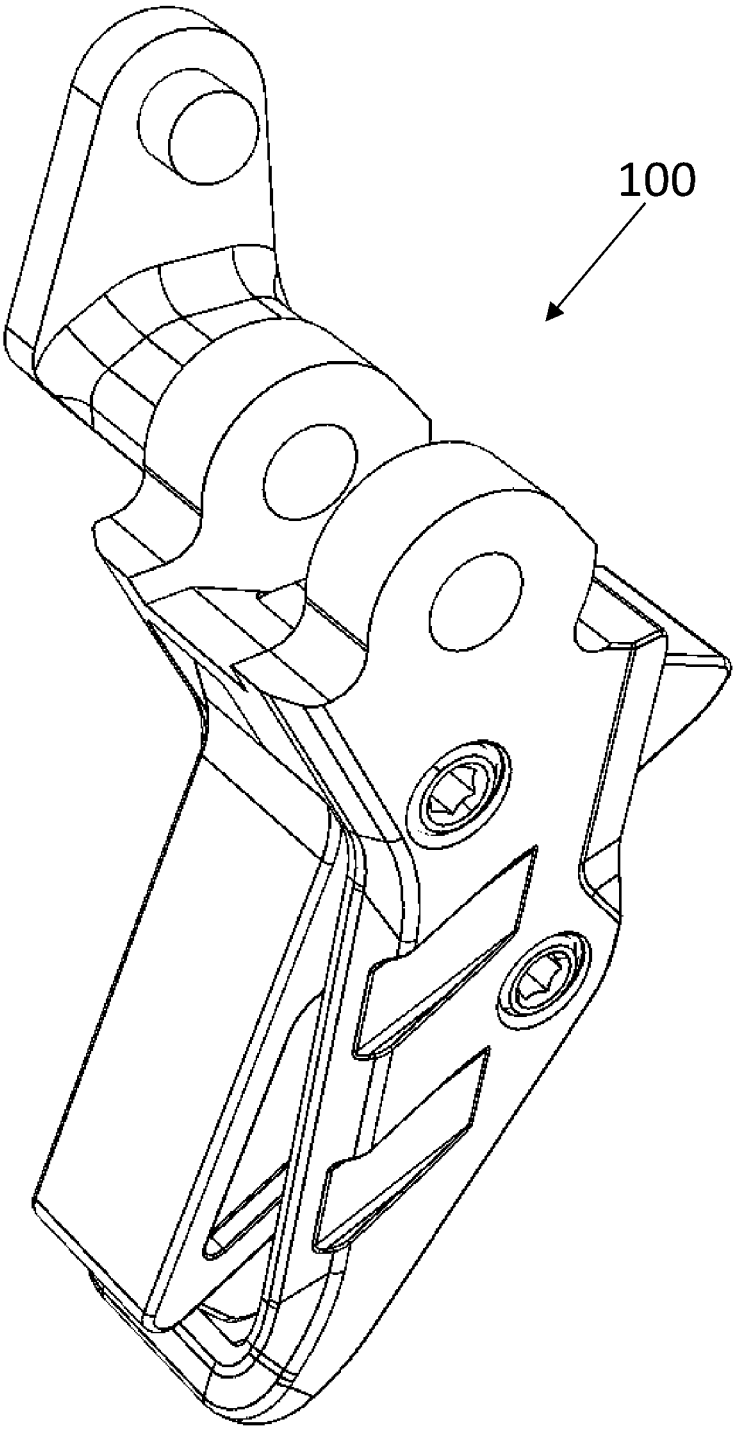
FIG. 1 represents a perspective view of a safety trigger system.
Figure 2:
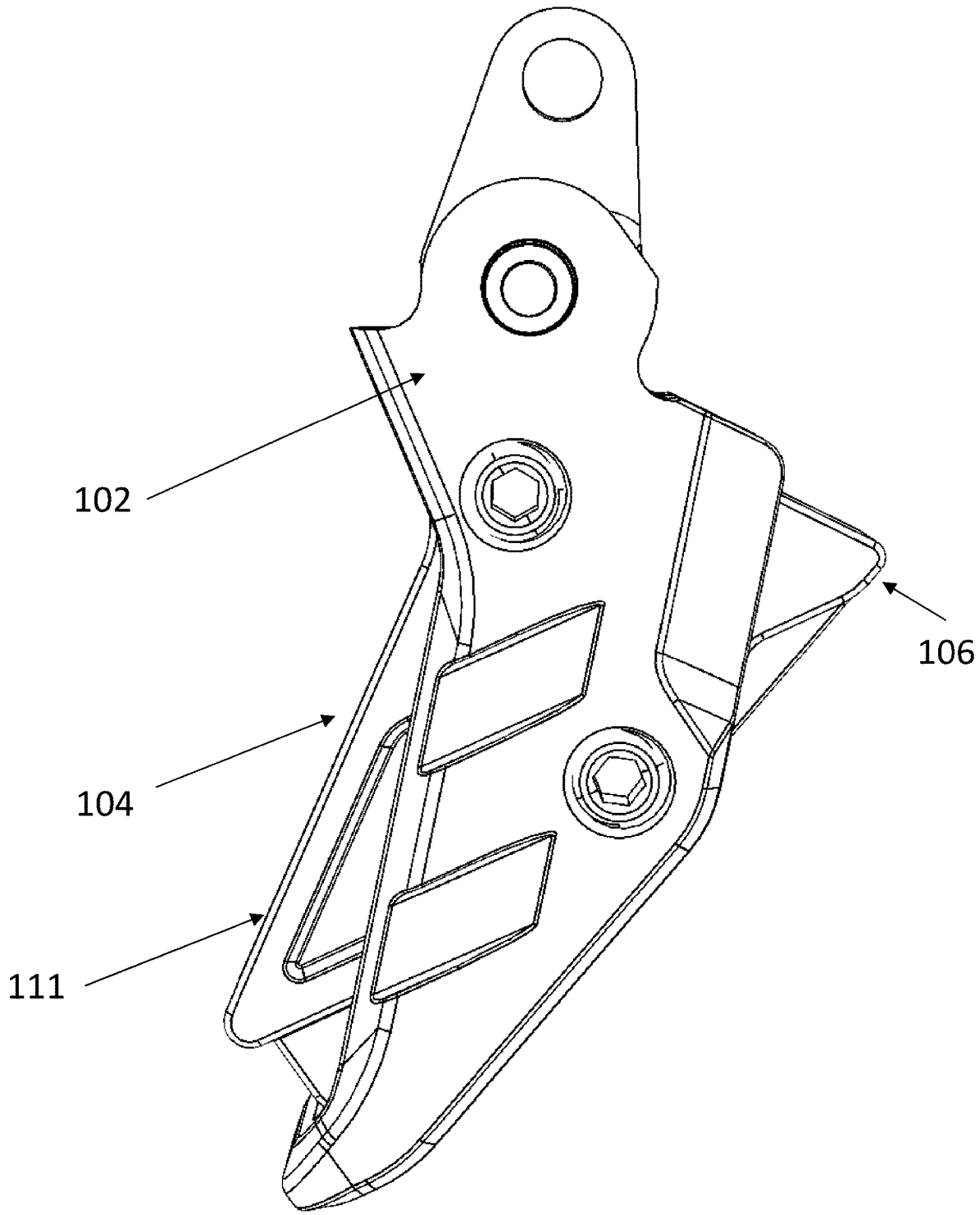
FIG. 2 represents a side view of a safety trigger system.

FIG. 1 and FIG. 2 represent a safety trigger system 100. The trigger system comprises 100 a trigger housing 102, a safety blade member 104, a safety latch member 106, a resistance member 108 (not shown in FIG. 1 and FIG. 2), and a plurality of pivot members 110, 112.

Figure 3:
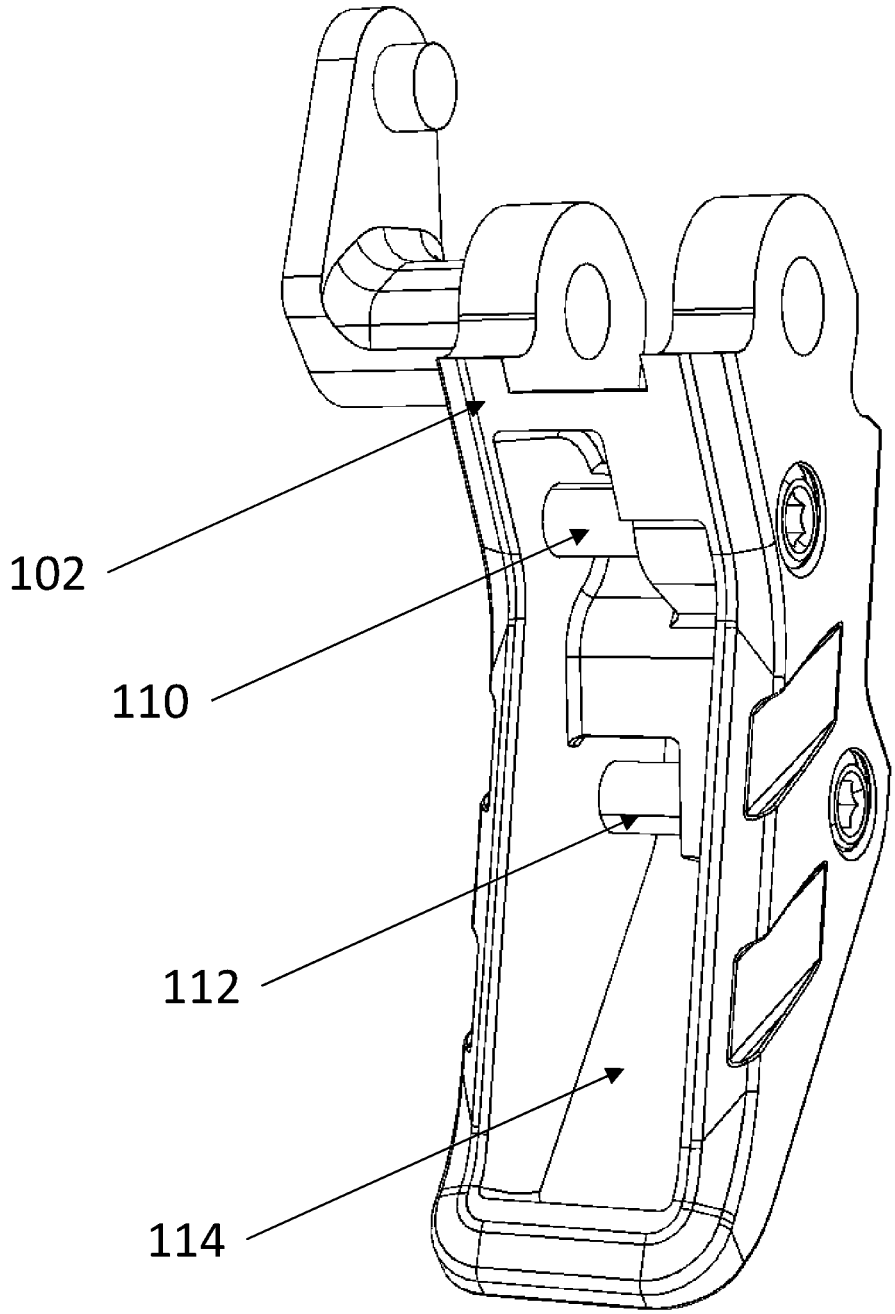
FIG. 3 represents a perspective view of the trigger housing.
Figure 4:
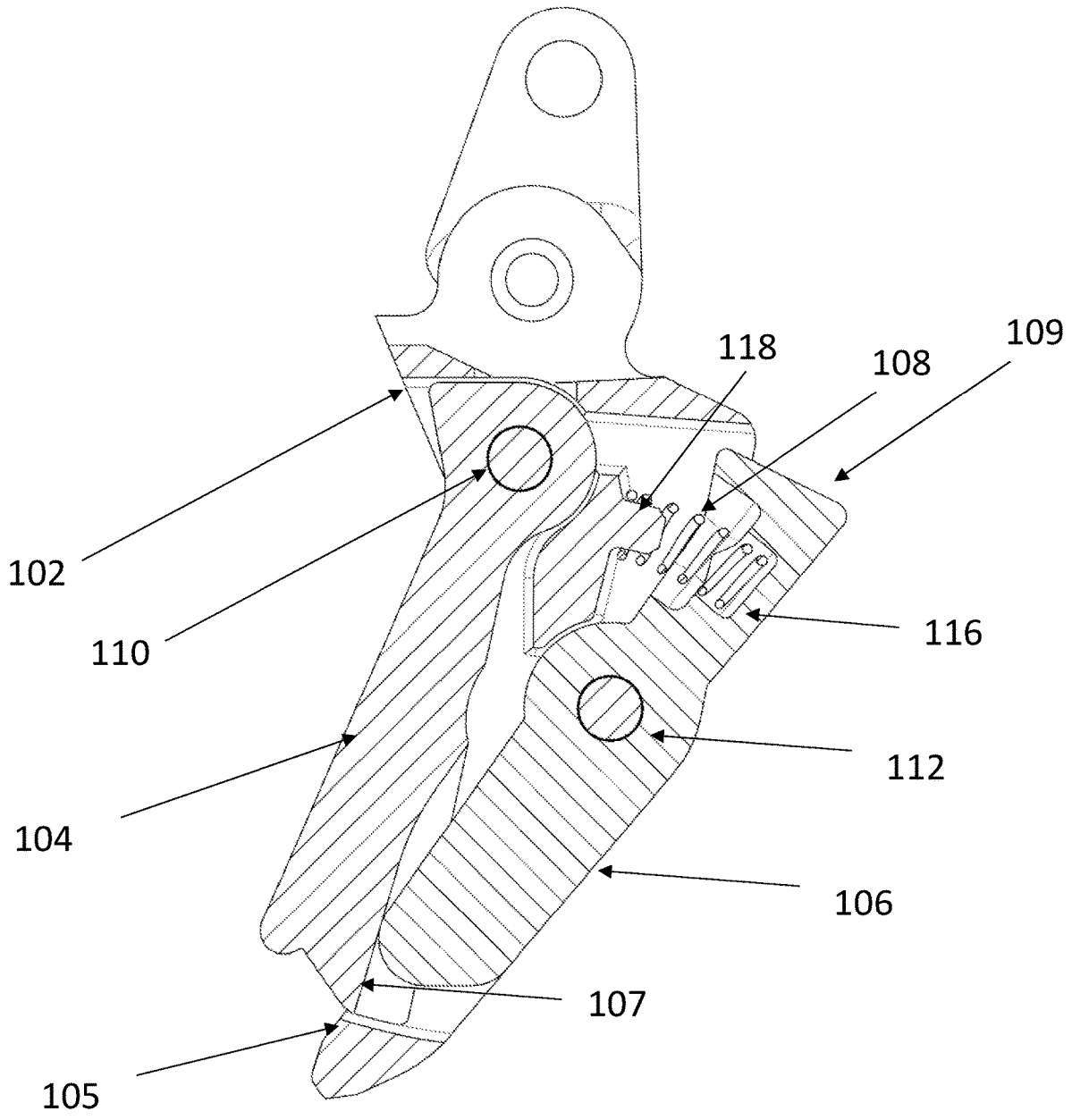
FIG. 4 represents a cross section of the safety trigger system.

The trigger housing 102 is further detailed in FIG. 3 and the partial cross section shown in FIG. 4. As shown in FIG. 3, the trigger housing 102 comprises a slot 114 configured to accommodate the assembly of safety blade member 104 and the safety latch member 106.

As shown in the cross section of the trigger system 100 in FIG. 4, the safety blade member 104 is disposed in the trigger housing slot 114 and rotatably coupled to the trigger housing 102 through a first pivot member 110. In an assembled first state, the safety blade depression portion 111 protrudes through the front of the trigger housing allowing access for digital depression. The safety latch member 106 is disposed in a rear portion of the trigger housing slot 114 and rotatably coupled to the trigger housing 102 through a second pivot member 110. In an assembled state, a safety latch engagement portion 107 is physically engaged with a safety blade engagement portion 105 and a safety latch interference portion 109 protrudes from a top portion of the trigger housing 102.

Further As shown in FIG. 4, the resistance member 108 is coupled to the safety latch member resistance member locating feature 116 and a trigger housing resistance member locating feature 118. The resistance member is configured to apply a resistive force between the trigger housing 102 and the safety latch member 106 rotatably biasing the safety latch member along the second pivot member 112 into the first assembled pre-depressed position in contact with the safety blade member 104. The safety latch member resistance member locating feature 116 may comprise a stud inserted into the resistance member 108 configured to restrict movement of the resistance member or a bore, hole, or pocket in which the resistance member 108 is inserted into. Further, the trigger housing resistance member locating feature 118 may comprise a stud inserted into the resistance member configured to restrict movement of the resistance member or a bore, hole, or pocket in which the resistance member is inserted into. One example of a resistive member 108 includes but is not limited to a spring.

Figure 5:
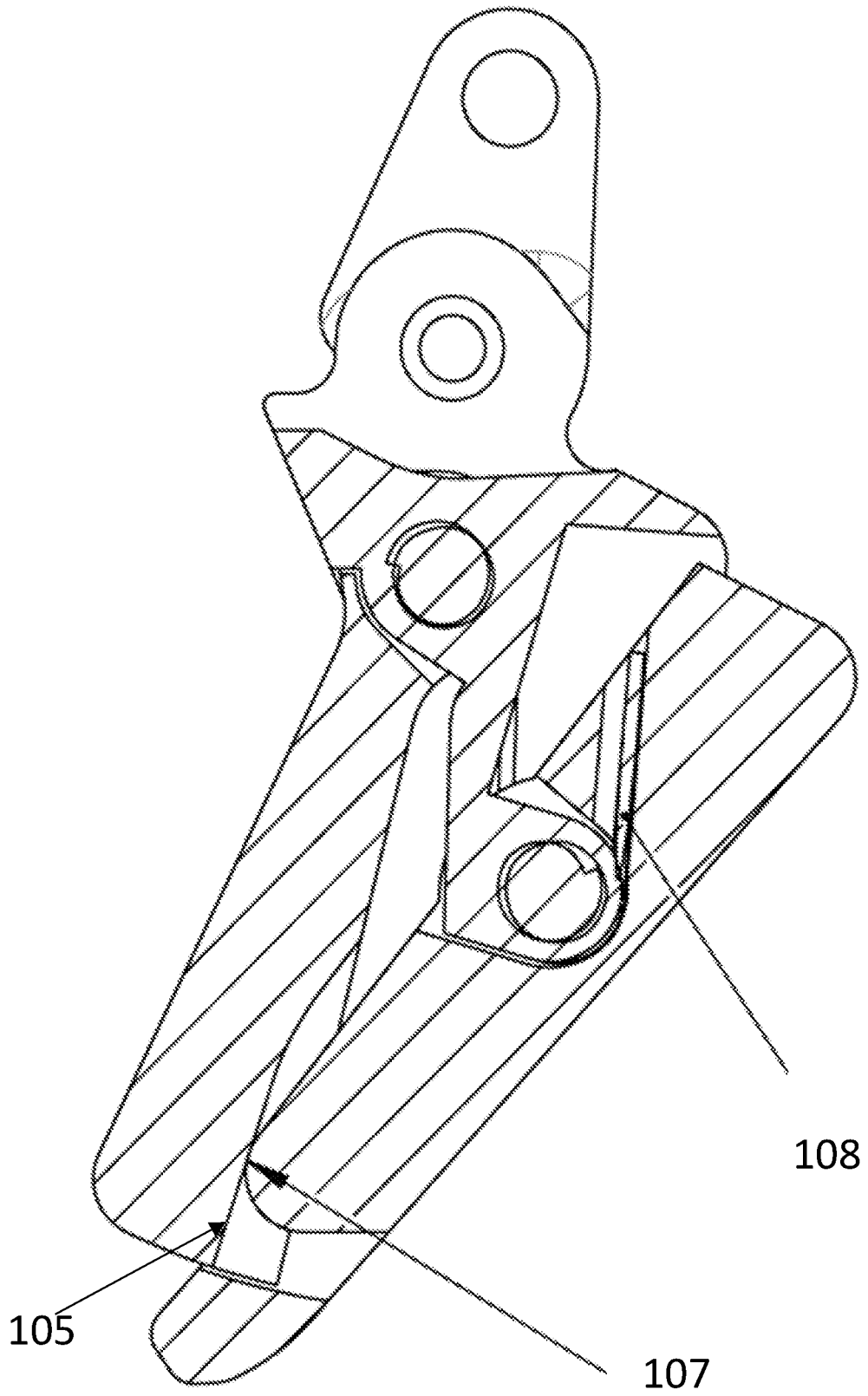
FIG. 5 represents a cross section of the safety trigger system with an alternate resistance member.
Figure 6A:
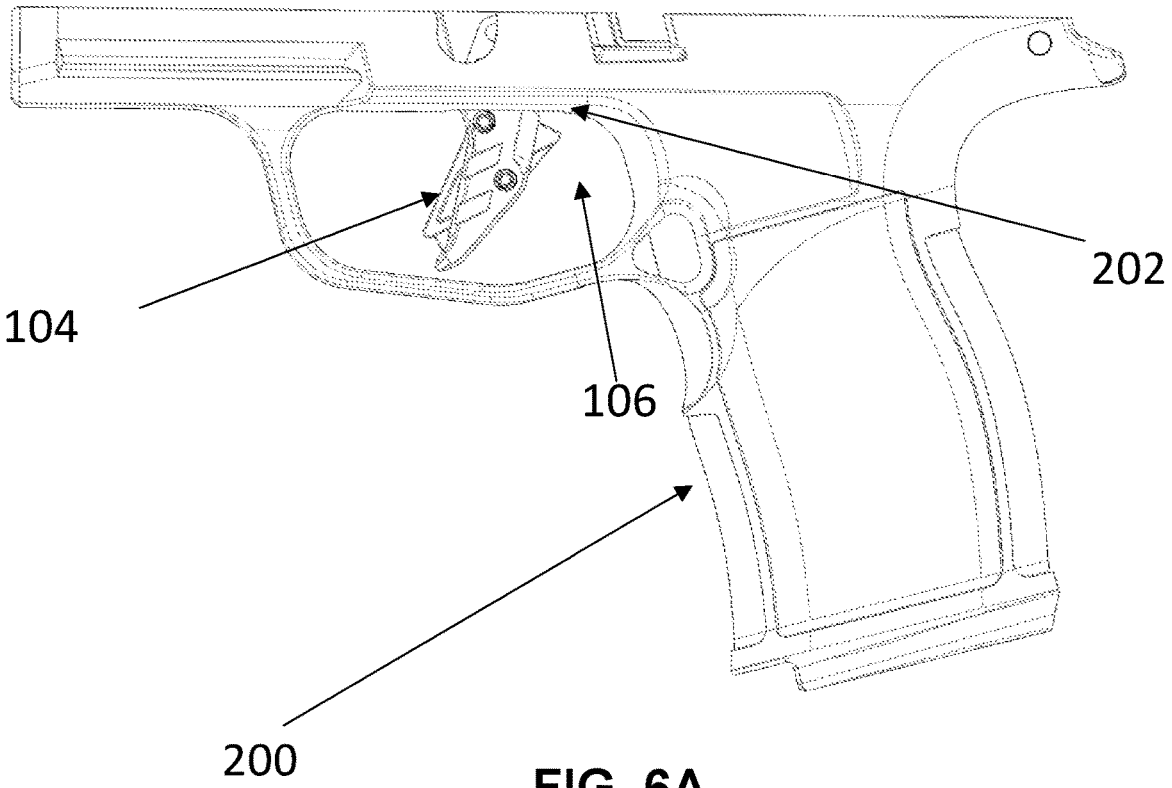
FIGS. 6A-6B represent the safety trigger system installed in a firearm in a pre-depressed state.
Figure 6B:
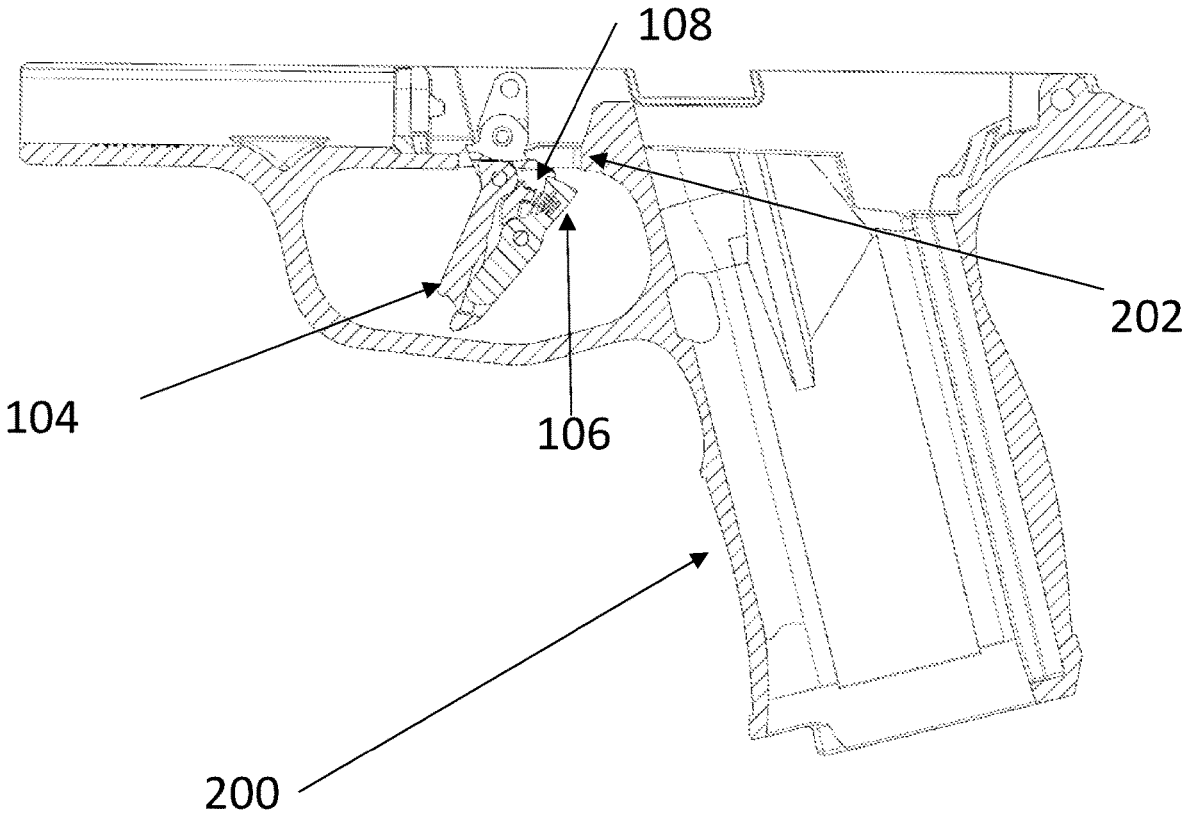

In an alternative aspect, as shown in FIG. 5 and FIG. 6, the resistance member is coupled to the first pivot member and the second pivot member and configured to apply a resistive force to both the safety blade member 104 and safety latch member 106 rotatably biasing both the safety blade member 104 and safety latch member 106 along the pivot members 110 and 112 into the assembled, pre-depressed positions. Upon depression of the safety blade, the resistive force of the resistive member is overcome. In a depressed state, the safety blade is rotated into the trigger housing, which in turn applies a force onto the bottom portion of the safety latch causing the safety latch to overcome the resistive force of the resistance member and rotate about the second pivot member. One example of a resistive member includes but is not limited to a torsion spring.

In either resistance member 108 configuration one of skill in the art would recognize that a number of different types spring members may be used to bias the safety blade member 104 or safety latch member 106 into appropriate positions and that the resistance member 108 may be assembled directly to the safety blade member 104 or safety latch member 106 or other components within the trigger housing 102.

Figure 7A:
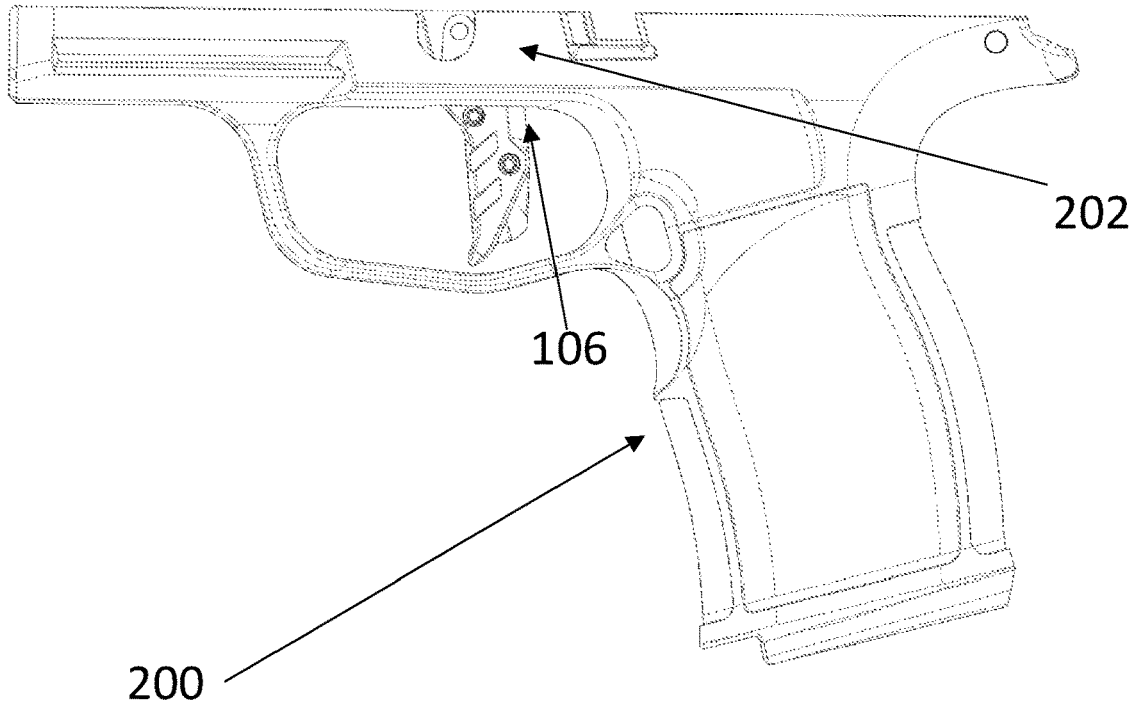
FIG. 7A-7B represent the safety trigger system installed in a firearm in a depressed state.
Figure 7B:
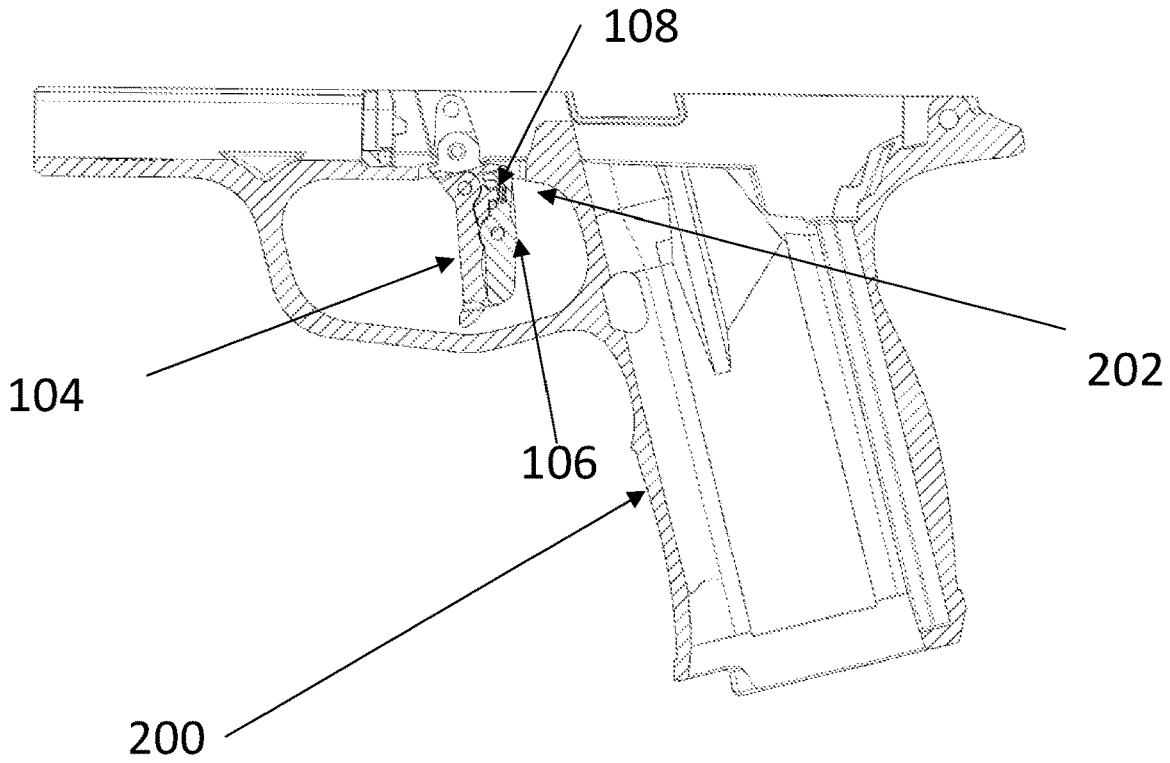

In operation as shown in FIGS. 7-8, the trigger system 100 is assembled into a firearm 200. In the assembled state, the upper portion of the safety latch member 106 interferes with the firearm housing 202 and prevents travel of the trigger system 100 without depression of the safety blade member 104. In a pre-depressed state, the trigger system 100 is prevented from traveling the entire trigger stroke required to release the firing pin of the firearm 200. In a depressed state, the depression of the safety blade member 104 applies a force to the bottom portion of the safety latch member 106 causing the rotation of the safety latch member 106 about the second pivot member 112. The safety latch member 106 in a depressed rotated position no longer interferes with the firearm housing 202 and allows for the trigger system 100 to travel the entire trigger stroke and release the firing pin of the firearm 200.

The interaction between the safety blade member 104 and the safety latch member 106 allows for a multiplication of the travel distances between each part respectively. Ultimately, this interaction allows for the safety blade member 104 to remain within a comfortable travel range, while the safety latch member 106 travels at a greater or smaller distance (depending on the firearm design) to achieve locking and unlocking of the trigger assembly 100.

In another aspect, a method of securing a firearm comprises the steps of installing a safety trigger assembly 100 in a firearm housing 200 the safety trigger system 100 comprising a trigger housing 102, a safety blade member 104, a safety latch member 106, a resistance member 108, and a plurality of pivot members 110, 112 wherein in a first pre-depressed state, the safety latch member 106 interferes with the firearm housing 200 preventing a complete trigger travel stroke and preventing the release of the firearm firing pin.

In yet another aspect, a method firing a firearm comprising a safety trigger assembly comprises the steps of depressing the trigger housing 102 and safety blade member 104, rotating the safety blade member 104 into the safety latch member 106, rotating the safety latch member 106 to clear an interference with the firearm housing 200, allowing the full trigger stroke to release the firearm firing pin.

Those of ordinary skill in the art will understand and appreciate the aforementioned description of the invention has been made with reference to certain exemplary embodiments of the invention, which describe a safety trigger system and method of use. Those of skill in the art will understand that obvious variations in construction, material, dimensions or properties may be made without departing from the scope of the invention which is intended to be limited only by the claims appended hereto.

The invention claimed is:

1. A safety trigger system comprising:

a trigger housing having a trigger housing slot;

a safety blade member disposed in the trigger housing slot rotatably coupled to the trigger housing, the safety blade member having a safety blade depression portion and a safety blade engagement portion;

a safety latch member disposed in the trigger housing slot rotatably coupled to the trigger housing, the safety latch member having a safety latch engagement portion and a safety blade interference portion; and a resistance member disposed in the trigger housing, wherein the resistance member provides a resistance force on the safety latch member biasing the safety latch engagement portion into the safety blade engagement portion to cause the safety blade depression portion to protrude out of the trigger housing slot through a front face of the trigger housing and biasing the safety latch interference portion to protrude out of the trigger housing slot through a rear face of the trigger housing.

2. The safety trigger system of claim 1 wherein the safety blade member is coupled to the trigger housing through a first pivot member extending laterally through a top portion of the trigger housing slot and the safety latch member is coupled to the trigger housing through a second pivot member extending laterally through a mid rear portion of the trigger housing slot.

3. The safety trigger system of claim 2 wherein the resistance member comprises a spring coupled to the trigger housing and the safety latch member.

4. The safety trigger system of claim 3 wherein the resistance member is coupled to a trigger housing locating feature at a first end, and a safety latch locating feature on a second end and the trigger housing locating feature and the safety latch locating feature are configured to restrict vertical and horizontal movement of the resistance member.

5. The safety trigger system of claim 4 wherein the trigger housing locating feature or the safety latch locating feature is any of a stud, post, bore, hole, or pocket.

6. The safety trigger system of claim 2 wherein the resistance member comprises a torsion spring coupled to the first pivot member and the second pivot member.

7. The safety trigger system of claim 1 wherein in a depressed state, the safety blade member is depressed and rotated into the trigger housing slot engaging the safety latch engagement portion rotating the safety latch member to overcome the resistance force and rotating the safety latch member interference portion further into the trigger housing slot.

8. The safety trigger system of claim 1 wherein the safety trigger system is assembled into a firearm housing and further wherein travel of the trigger system is limited by an interference between a portion of the firearm housing and the safety latch member interference portion.

9. The safety trigger system of claim 8 wherein in a depressed state, the safety blade member is depressed and rotated into the trigger housing slot engaging the safety latch engagement portion rotating the safety latch member to overcome the resistance force and rotating the safety latch member interference portion further into the trigger housing slot thereby clearing a firearm housing interference.

* * * * *